US006446967B1

(12) United States Patent
Jamali

(10) Patent No.: US 6,446,967 B1
(45) Date of Patent: Sep. 10, 2002

(54) BOARD WORD GAME APPARATUS AND METHOD

(76) Inventor: Khalid Jamali, 3050 SW. 10$^{th}$, Unit #36, Portland, OR (US) 97201

( * ) Notice: Subject to any disclaimer, the term of this patent is extended or adjusted under 35 U.S.C. 154(b) by 0 days.

(21) Appl. No.: 09/541,011

(22) Filed: Mar. 31, 2000

(51) Int. Cl.$^{7}$ ..... A63F 3/00
(52) U.S. Cl. ..... 273/236; 273/293
(58) Field of Search ..... 273/236, 292, 273/293, 272, 299

(56) References Cited

U.S. PATENT DOCUMENTS 4,350,342 A * 9/1982 Barulich
4,923,199 A * 5/1990 Hahn
5,018,975 A * 5/1991 Todd

* cited by examiner

*Primary Examiner*—Benjamin H. Layno
*Assistant Examiner*—Vishu K Mendiratta

(74) *Attorney, Agent, or Firm*—Donn K. Harms

(57) ABSTRACT

A Method for playing a game on a game board divided into a plurality of horizontal rows bearing the first letter of an alphabet and segmented into a plurality of rectangles by a plurality of vertical columns labeled with one, or a combination of, a multiplier and a color zone which intersect the rows. Each player receives a defined number of letters having a letter value from the letters of the alphabet being used. The players in order play the game by positioning their letters on the board adjacent to the first letter of the alphabet or adjacent to a prior formed word to form a new word. The point scores for the new word formed are calculated by summing the points for the individual letters of the formed word and multiplying them by the designated multiplier intersecting the last letter of the word, Additional points and bonus tiles are awarded for longer words ending in colorized zones. The bonus tiles can be used as any letter of the alphabet to form a new word, or, to negate the score for a word formed by an opponent player. The game and method lends itself to electronic play on computers or televised game shows for prizes.

10 Claims, 9 Drawing Sheets

| | X0 | X1 | X2 | X3 | X4 | X5 | X6 | X7 | X8 | X9 | X10 | X11 |
|---|---|---|---|---|---|---|---|---|---|---|---|---|
| A | N | S | W | E | R | I | N | G | | | | |
| B | H | A | T | S | | | | | | | | |
| C | | | | | | | | | | | | |
| D | E | V | I | L | | | | | | | | |
| E | | | | | | | | | | | | |
| F | F | U | R | N | I | S | H | I | N | G | S | |
| G | | | | | | | | | | | | |
| H | E | A | T | | | | | | | | | |
| I | R | R | E | S | P | O | N | S | I | B | L | Y |
| J | O | Y | S | | | | | | | | | |
| K | E | E | P | E | R | S | | | | | | |
| L | | | | | | | | | | | | |
| M | O | N | E | Y | | | | | | | | |
| N | | | | | | | | | | | | |
| O | | | | | | | | | | | | |
| P | E | A | R | L | S | | | | | | | |
| Q | | | | | | | | | | | | |
| R | | | | | | | | | | | | |
| S | I | X | | | | | | | | | | |
| T | A | T | T | O | R | N | E | Y | | | | |
| U | | | | | | | | | | | | |
| V | | | | | | | | | | | | |
| W | | | | | | | | | | | | |
| X | | | | | | | | | | | | |
| Y | E | A | R | | | | | | | | | |
| Z | O | O | | | | | | | | | | |

FIGURE 8

| Player Name | Player One | | |
|---|---|---|---|
| Conqueror Against | Word Played | Word Score | Turn Score |
| | ANSWER | 36 | 36 |
| * | FURNISHINGS | 119 | - |
| | MONEY | 24 | 143 |
| | ATTORNEY | 76 | - |
| | HEAT | 14 | 90 |
| | DEVIL | 24 | - |
| | JOYS | 14 | - |
| | ZOO | 6 | - |
| | YEAR | 14 | 58 |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
| | | Total | |

FIGURE 9

BOARD WORD GAME APPARATUS AND METHOD

BACKGROUND OF INVENTION

1. Field of Invention

The present invention relates to a board game. More particularly, it relates to a board game in which players use letters provided in the form of letter tiles to form words for which points are awarded to the individual player.

2. Prior Art

A large variety of word based games are ones which can be played by one or more players. Many such games are based on a crossword type game board that allows players to score points using parts of the prior players words. Such games require a large vocabulary and the forward thinking of a chess player in order for a player to become adept and, therefor, favor players who possess a large and varied vocabulary and can plan many moves ahead.

Such vocabulary requirements and the concentration ability to plan ahead are not traits possessed by children and, as such, are not popular with them. Additionally, such word based games require such planning and strategy as to be more work than play and not a popular form of recreation to those seeking a fun diversion during times of rest and relaxation.

Another limiting factor of such games is that they generally only allow the players to score points. Thus, the players that are more adept at offense or possess the better planning and language skills are at an advantage. Generally, there exists no way in such games to affirmatively engage in defensive moves or actions that will lower the other players obtained score. Still further, because of the extreme differences in the vocabulary abilities of adults or parents, and that of children, there is little incentive for children to play with adults in most such word games.

Consequently, there exists a need for such a word game that is easy to play, has few rules, and allows players of all abilities a relaxing and entertaining endeavor during recreation and relaxation periods. Such a game should allow play between adults with varied vocabulary levels and should not require an overly large amount of forward planning by the participants. Children, too, would benefit by such a game in that they could play with each other and in many cases be able to compete with adults if the rules were simple and the playing field leveled by such rules. Such a game would also provide in the rules for the ability to make defensive moves to allow a player to have the opportunity to reduce the score of an opponent.

SUMMARY OF THE INVENTION

The present invention, named ALPHACONQUEST, overcomes the above mentioned disadvantages and shortcomings by providing a method of play that has few rules requiring advance planning by the players. Additionally, it allows players with higher levels of vocabulary skills the ability to score higher points by initiating words, while concurrently giving those with lower levels of such skills the opportunity to score bonus points from building off the words of the more skilled player. Players are also afforded an opportunity to play defense to reduce the score of opponents.

The game herein disclosed also allows players of all levels of verbal skill to effectively play together. Players with higher verbal and reading abilities can score larger by initiating words on the board for increased point scores.

Players with lower vocabulary abilities can score bonuses by adding to already played words, and achieve bonus points and bonus letter tiles that can negate the other players scores. Players can also help even the score with an opponent by earning bonus tiles which afford the opportunity to negate the score of an opponent or to use as "wild cards" in the formation of words.

In the preferred embodiment of ALPHACONQUEST herein disclosed, players compete using a defined number of letter tiles representing the alphabet of the language in which the game is being played. Because of the game's simple rules and board types, it can easily be played in any language and such is anticipated. The embodiment herein described is that of the English language embodiment and the letters of the English alphabet. The letter tiles are played upon a provided board and the player receives a defined number of points for each such play. Bonuses can be achieved through playing longer words.

To begin the game, the rotation or order of the players is decided by two to five players randomly drawing letters from a container holding a provided collection of letter tiles representing all of the twenty-six letters of the English alphabet. The player drawing the lowest letter in the order of the alphabet used goes first, the other players following a next in an in-order rotation of seated players around the game board conventionally in a clockwise fashion. Players then initially choose twelve letter tiles from the provided container and place them on a rack in front of the player's respective position around the provided game board.

One possible game board features twenty-six horizontal rows of boxes drawn upon the board. Each such row contains thirteen letter tile sized boxes. The first box in each row being that of a letter of the English alphabet in the conventional order starting from the top of the game board. The letter contained in the first such box of the row is considered the master letter of that row with their being a total of twenty-six master letters in the English alphabet.

The game board also features twelve vertical columns of squares. A first column being that of the aforementioned master letters and then the twelve vertical columns situated to the right of the master letters and thereby determining the number of playing spaces or squares adjacent to each master letter. The playing spaces determine where letters may be laid and hence where the game may be played. Each master letter would therefor have twelve spaces or squares to the right of that master letter in which letter tiles may be played.

Each of these vertical columns are labeled at the top of the respective column with a zero through eleven. This numerical label thereby identifies and determines a multiplier for points achieved on a word spelled to the right of one of the master letter, depending upon which column the last letter of the word occupies. This multiplier multiplies the score of the word by the factor of the multiplier.

Also included on the game board are colorized columns to award additional bonuses to players achieving word endings in these colorized columns. The columns designated with the multiplier seven, eight, or nine are colorized in a first separate color, in the current mode orange, to indicate that a bonus is awarded for a word long enough to end in these columns. The multiplier columns designated by the multiplier ten and eleven are also colorized with a second different color to signify that words long enough to end in these columns achieve a different bonus to the player accomplishing the task. In this case the second color would be maroon to differentiate from the first. Of course the colors used in the board manufacture could differ so long as they are different from each other and from the color of the main board itself.

The different bonus points achieved by the multiplier and by the differing colored columns act to provide a number of twists and player skill leveling where players of unequal vocabulary skills are playing. A player who plays the initial word in a horizontal row, gets four points for using the master letter of that row, plus one point for each letter tile laid, with the sum of the master letter points and the letter tile points being multiplied by the factor in the multiplier in the multiplier column of the last letter of the word. Other players may add to the word but will not receive the four points for the master letter tile when multiplying the total number of letter tiles by the multiplier in the new column where the word would end. This gives an advantage to the player who initiates the word in the horizontal row using the master letter in that the master letter is worth four points toward the word total and that four points is multiplied by the multiplier factor at the end of the initial word.

An equalizing factor for those players unable to initiate words due to vocabulary or other differing abilities exists. By adding to words already laid down, the subsequent player receives the value of the tiles laid with only one point for the master letter, but multiplied by a larger multiplier factor in the column where the new word ends.

Additionally, as noted earlier, the multiplier columns at the opposite end of the horizontal row from the master letter are colorized. This colorization creates a first and second colorized zone that signifies additional bonuses to a player who is able to terminate a word in one of these zones.

The first colorized zone awards the player ending a word therein a twenty point bonus on top of the score awarded after the word total is multiplied by the multiplier factor of columns seven eight or nine. Consequently the player would get the total of the points for the length of the word, times the multiplier factor, plus an extra twenty points.

The second colorized zone awards the player ending a word therein with a forty point bonus on top of the multiplied word score, and, a special letter tile called the CONQUEROR tile. This special tile has two optional purposes used at the discretion of the player possessing it. First, it may be used as a "wild card" in place of any letter of the alphabet in the forming of any word, or, second, it may be used defensively. In the second mode, the Conqueror tile may be laid atop a previous word laid by another player to negate the entire score the previous player received from that word. The Conqueror tile is the most prized bonus that a player can have due to the ability to make defensive moves with the tile to negate a score, or to use it as a wild card in the formation of a word. It is a great equalizer amongst players since it may be used by one player to reduce the total score of another player.

One final rule also allows for continued play when letters to form words may become short near the end of the game or when a player lacks the ability to form a word using a master tile as a starting point. As long as a player can form an entire word from the tiles on the players rack, that player may lay the word in any horizontal row adjacent to the master letter in that row. The master letter need not be part of the word formed, however, when the word formed is multiplied by the multiplier factor in the column in which it ends, the points for the master letter that was not used are not added to the sum of the points for the word and only one point for each tile is summed up to be multiplied.

Once a player places his tiles and completes a word, he then draws the number of tiles necessary to bring the total number of tiles he possesses back up to twelve. Another player then begins his turn.

The end of the game occurs at the earlier of when all the tiles are played, or, when no player can form any new word or add to any played word with the tiles in their possession.

As can be seen, awarding more points to a player who can begin a word using a master letter and use long words to begin with gives an advantage to players with a large vocabulary. However, that advantage is equalized by the ability of less skilled players to extend the words into one of the colorized columns and obtain bonus scores and ultimately the ability to negate the prior score of another player with a bonus tile or to use that tile as a wild card to form a word. Such a give and take will allow for a constant struggle between the participants of the game for the lead and eventual win.

Two additional embodiments are game boards containing variations on the twenty-six master letter version. Rather than containing all of the letters of the English alphabet, or, twenty-six master letters, one game board would contain only vowels, or, in the English alphabet version, five master letters, and the other game board would contain only consonants as master letters, or, in the English alphabet version, twenty-one master letters. The game would continue to be played in the fashion set forth, inclusive of master letter points, multiplier points, and the awarding of Conqueror tiles. Such game boards might be used to teach children to find words that begin with vowels or consonants and would thus help to improve vocabulary skills.

There also exists the possibility of additional game boards which would contain any number of master letters in conjunction with multiplier columns in excess of, or fewer than, the twelve multiplier columns (zero through eleven) already described. One such game board, in the English alphabet version, would contain twenty-six master letters and twenty-one multiplier columns (zero through twenty). Game play would continue in the fashion set forth, however, bonus points might be awarded at ten points for words ending in the multiplier columns six through eight, twenty points for words ending in the multiplier columns nine through eleven, forty points for words ending in the multiplier columns twelve through fourteen, sixty points for words ending in the multiplier columns fifteen through seventeen and one hundred points for words ending in the multiplier columns eighteen through twenty. The Conqueror tiles would be awarded for words ending in certain columns determined before the start of play. Game boards containing multiplier columns in excess of twelve might be suitable for the experienced, or champion, players.

A game board could also contain only six multiplier columns (zero though five) with bonus points being awarded at five points for words ending in the multiplier column two, ten points for words ending in the multiplier column three, fifteen points for words ending in the multiplier column four, and twenty points for words ending in multiplier column five, and with a Conqueror tile awarded for words ending in column five. This game board might be suitable for children players or for those seeking a shorter game play time.

Any game board could be constructed so that the master letters run along the top of the game board from left to right, with the multiplier columns extending from top to bottom along the side of the board. In this version, the words played would extend from top to bottom rather than from left to right. Versions of the game can also be produced in any number of languages and such is anticipated. Of course, the alphabets of other languages may have more or less letters or different orders of presentation of the alphabet. This might require more or less rows depending on the number of letters of the alphabet in the language in which the game is played. However, the letter in the first box of each row would be considered the master letter of that row for game purposes.

All game board versions preserve the original intent of the game which is to allow play between people with varying levels of vocabulary ability, such as children and adults, by providing a means for adding on to words already formed, and a means for affirmatively engaging in defensive moves or actions that will lower the other players obtained score.

The game kit of this invention will now be described with reference to embodiments thereof as illustrated in the attached drawings which should not, however, be taken as limiting the scope of this game invention.

BRIEF DESCRIPTION OF DRAWING FIGURES

FIG. 8 is a top view of the board game depicted in FIG. 1 with words inserted as if a game was played.

FIG. 9 is a top view of a possible score card illustrating how the game depicted in FIG. 8 might be scored.

DETAILED DESCRIPTION OF THE PREFERRED EMBODIMENTS OF THE INVENTION

Figure 1A:
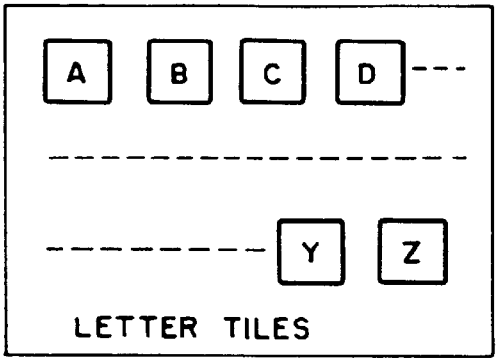
FIG. 1 depicts the various parts of the game kit.
Figure 1B:
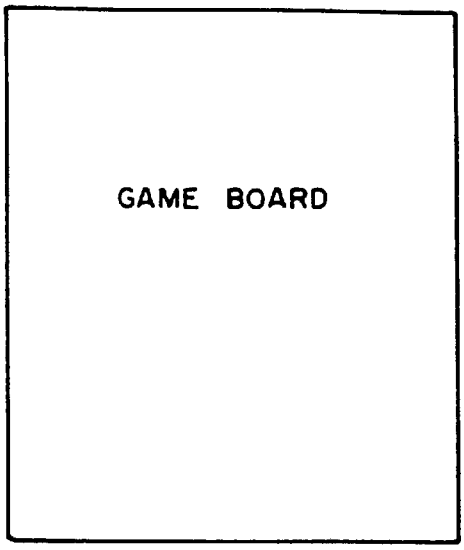
Figure 1C:
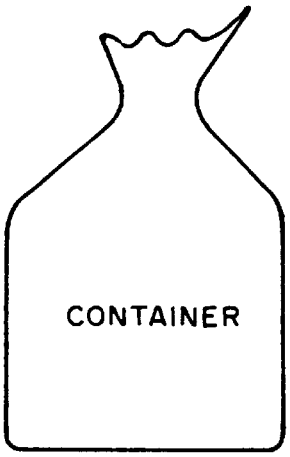
Figure 1D:
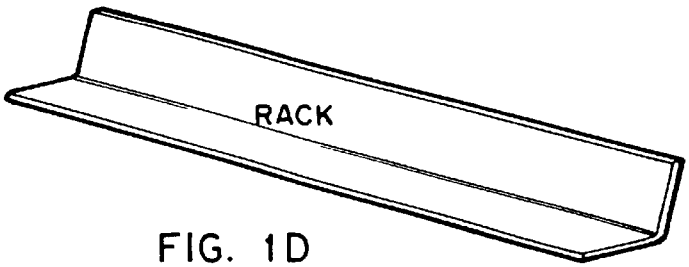
Figure 1E:
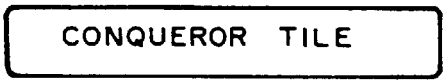
Figure 1F:
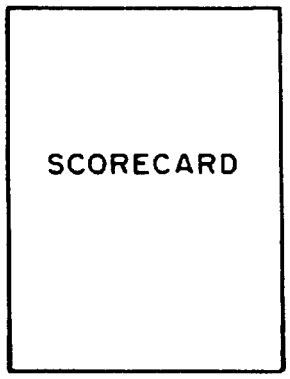
Figure 1G:
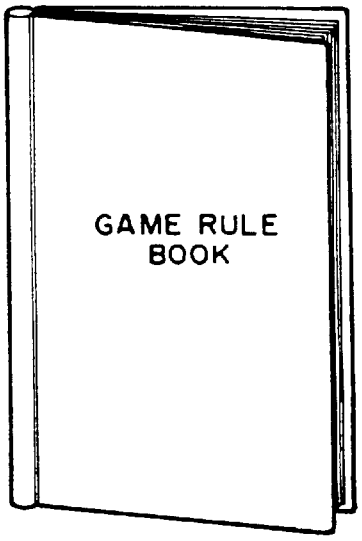

Referring now to the drawings, FIGS. 1–9 depict the preferred embodiments in the English language and alphabet version of the game board of the invention disclosed herein. Since the English language uses conventional Latin letters, the depicted version, with little or no alteration could also be used in other versions such as Spanish, French, Italian, German, and Dutch, since these languages use the same letters as English. In the preferred embodiment of ALPHA-CONQUEST herein disclosed, a game kit 10 would be used by the players competing in a game. The game kit 10 would come with a defined number of letter tiles 12 representing the alphabet of the language in which the game is being played. In the case of the English language version which is herein disclosed, the total tiles distributed with the kit 10 in the current best mode of the game would be one hundred and sixty-six in the following distribution by letter:

A: fourteen tiles; B: six tiles; C: seven tiles; D: six tiles; E: twenty tiles; f: four tiles; G: five tiles; H: four tiles; I: twelve tiles; J: three tiles; K: three tiles, L: seven tiles; M: six tiles; N: six tiles; O: six tiles; P: four tiles; Q: two tiles; R: ten tiles; S: eight tiles; T: eight tiles; U: six tiles; V: 4 tiles; W: 4 tiles; X: 4 tiles; Y: four tiles; and Z: four tiles.

Of course, different numbers of tiles might be distributed in different versions of the game for different languages, or for harder or easier modes of play, so long as a defined number of tiles is distributed to be used in play of the game. The aforementioned defined distribution of letters is the current best mode for a general English language and alphabet version of the game using the rules outlined herein.

In the basic premise of the game, the letter tiles 12 are played upon a provided game board 14 and each player receives a defined number of points for each such play. Bonuses can be achieved through forming longer words using more letter tiles 12 and these bonuses can add more points, or the privilege to use special bonus tiles 16 to form new words or negate another players score.

In play, in all versions of the game, from a provided defined total number of letter tiles 12 representing all of the letters of the alphabet for the language in which the game is to be played, the players draw twelve letter tiles 12 from a tile container 18 and place them on a tile rack 20. The tile container 18 can be a bag, an urn, a plastic cup, or some other type of container sufficient to hold the defined number of tiles 12. From two to five players may play the game in the current best mode.

To begin the game, the rotation or order of the players is determined by random drawing of letters from the tile container 18 holding the defined number of letter tiles 12. The player drawing the lowest letter in the order of the alphabet used, goes first. The other players follow the first player in a in-order rotation of seated players around the game board 14 conventionally in a clockwise fashion.

Figure 2:
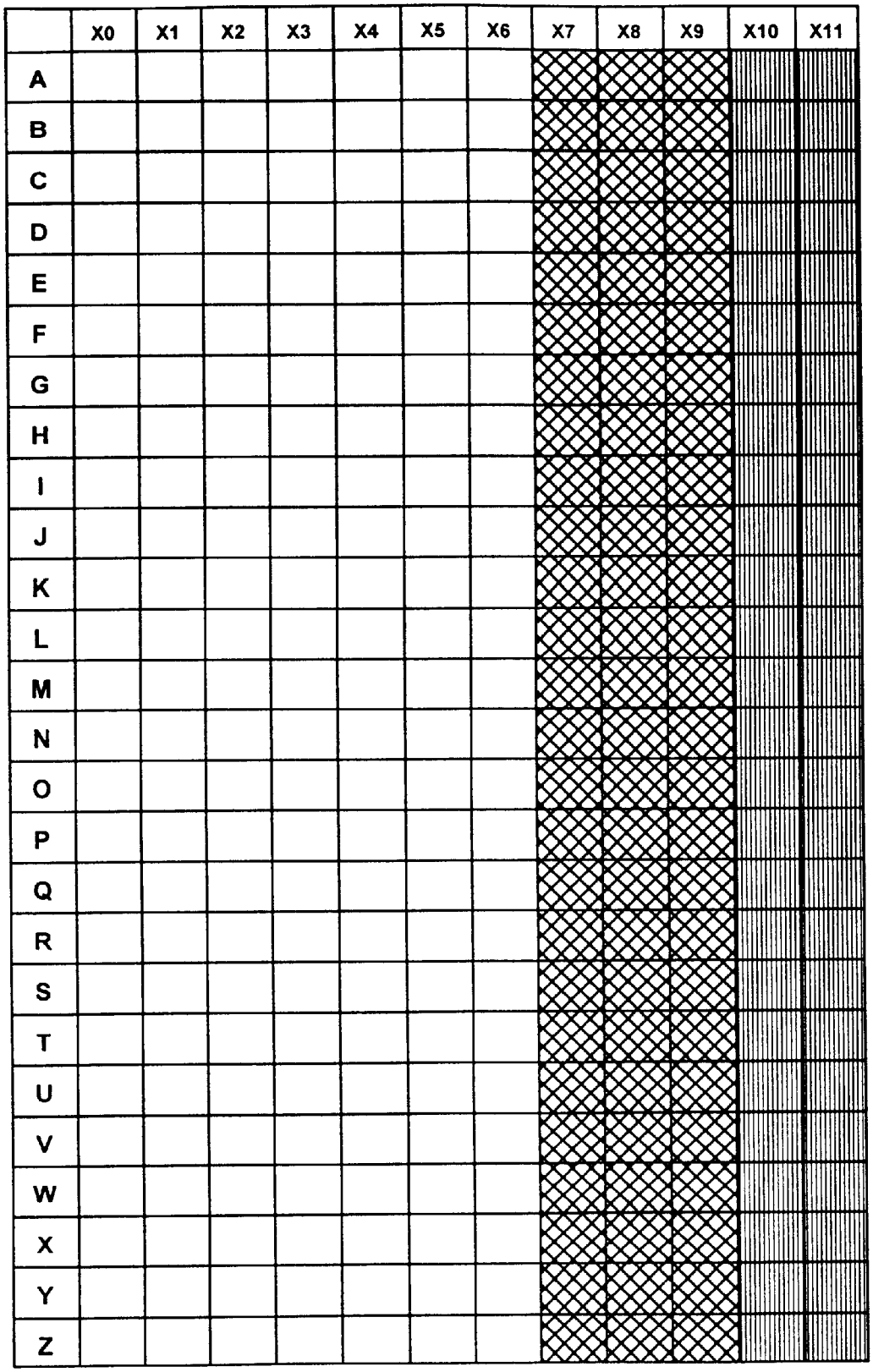
FIG. 2 depicts a top view of a twenty-six master letter, twelve multiplier column, English language and alphabet version of the game board.

In one embodiment, FIG. 2, the game board 14 features twenty-seven horizontal rows 22 of boxes 24 drawn upon the game board 14. Each such horizontal row 22 contains thirteen of the horizontal boxes 24 dimensioned to accommodate the outside dimensions of the letter tiles 12 when laid thereon. The first box 24 in each row 22 being that of a letter of the alphabet of the language in which the game is being played in the conventional order starting from the top of the game board 14. The letter contained in the first such box of the row is considered the master letter 26 of that horizontal row 22. As depicted in the English version, there would be twenty-six master letters 26 in the English alphabet. Since other versions of the game can also be produced in any number of languages and such is anticipated, the order of and number and characters of the master letters 26 could vary by language. However, in all cases the premise would be the same in that the alphabet of that language would be represented in order as master letters 26 of the horizontal rows 22.

In this embodiment of the game board 14, there exist thirteen vertical columns 28 also formed by the lines of the horizontal boxes 24. A first column being that of the aforementioned master letters 26 and twelve additional vertical columns 28 situated to the right of the master letters 26 thereby determining the number of horizontal boxes 24 to be used for play immediately adjacent to each master letter 26. The playing spaces, determined by the number of horizontal boxes 24, determines where letter tiles 12 may be laid during play. Each master letter 26 would therefor have twelve horizontal boxes 24 to the right of that master letter 26 in which letter tiles 12 may be played.

Also included on the game board 14 are a plurality of colorized columns to award additional bonuses to players achieving word endings in these colorized columns. The columns designated with the multiplier 30 of seven, eight, or nine are colorized in a first color 32, in the current mode orange, to indicate that bonus points are awarded for a word long enough to end in this column of the first color 32. The multiplier columns designated by the multiplier 30 labeled ten and eleven are also colorized with a second color 34 different from the first color 32 and the board color 36. This second color 34 signifies that the player formed a word long enough to end in the columns designated with the second color 34, and the player is awarded a bonus points and a bonus tile 16 for accomplishing the task. In the current best mode, the first color 32 is orange and the second color 34 would be maroon with the board color 36 being gray or neutral. Of course, the colors used could differ so long as they are different from each other to easily identify the bonus zone signified by the first color 32 and the second color 34.

The different bonus points achieved by ending a word on a certain multiplier 30, and by the aforementioned differing colored columns, serves to level the field of play where players of unequal vocabulary skills are playing the game. During play, as depicted in FIGS. 8 and 9, different skill levels and differing placement of letter tiles 12 act to award bonuses based on differing strengths and weakness of the players.

A player who plays the depicted initial word 38 in a horizontal row 22 is awarded four points for using the master letter 26 of that row, plus one point for each letter tile laid 12. The sum of the master letter 26 points at four, and the letter tile 12 points at one each, being multiplied by the factor in the multiplier 30 in the multiplier column of the last letter of the word 40. Subsequent players may add a segment 42 to the initial word 38, but they will not receive the four points for the master letter 26 tile in the initial word 38 when multiplying the sum total number of letter tiles 12 by the multiplier 30 in the new column where the added segment 42 ends. This gives an advantage to the player who forms the initial word 38 in the horizontal row using the master letter 26 since the master letter 26 is worth four points toward the word total and that four points is multiplied by the multiplier 30 factor at the last letter 40 of the initial word 38.

An equalizing factor for those players unable to initiate words due to vocabulary or other differing abilities exists. By adding segments 42 to initial words 38, the subsequent player receives the value of the tiles 12 laid and only one point for the master letter 26, but multiplied by a larger multiplier 30 factor in the column where the added segment 42 terminates.

Additionally, as noted earlier, the multiplier columns 28 at the opposite end of the horizontal row from the master letter 26 are colorized. This colorization creates a zone designated by the first color 32 and a second zone designated by the second color 34 where players are awarded additional bonuses for terminating a word therein.

A player terminating a word in a zone of the first color 32 receives a twenty point bonus on top of the score awarded after the word total is multiplied by the multiplier 30 factor of columns seven eight or nine. Consequently, the player would get the total of the points for the length of the word, times the multiplier factor, plus an extra twenty points.

Terminating a word in a zone signified by the second color 34 awards the player terminating that word a forty point bonus on top of the multiplied word score, and, the special bonus tile 16. Such a termination in the zone of the second color 34 could be arrived at by adding a segment 42 to a prior played word, or if the player has the letters and vocabulary to handle it, by an initial word 38. However, in practice, the most likely outcome is by adding a segment to a prior played word 38 and thus the player of less vocabulary ability has the ability to compete.

Players collecting the bonus tile 16 may thereafter use it at the option of the player possessing it. In the event they need letters to form a word and lack the letter tile 12 to do so, the bonus tile 16 can be used in place of any letter tile 12. In the event they are being outscored by an adept player, the bonus tile 16 may be used defensively to negate the entire score the previous player received from a word played. The bonus tile 16, due to the ability to make offensive or defensive moves, acts to equalize the differing player abilities of the game.

One final rule also allows for continued play when letters to form words may become short near the end of the game or when a player lacks the ability to form a word using a master tile as a starting point. Under this rule, as long as a player can form an entire word from the tiles on the players rack, that player may lay the word in any horizontal row 22 adjacent to the master letter 26 in that row. The master letter 26 need not be part of the word formed but the total score for the work will not include the points for that master letter 26.

The game ending occurs at the earlier of two events. First, when all the letter tiles have been played, or second, when no player is able to form any new word or add a segment 42 to any played word with the tiles in their possession.

The players keep score using score cards 44 and adding and subtracting their total aggregate scores. The player who has the highest aggregate score at the determined end of the game wins.

As can be seen, the advantages of placing initial words 38 is tempered by the advantage of adding segments 42 and terminating words in the colorized zones for bonuses. Thus, players with large vocabularies are at the constant peril of the player following adding segments 42 to the word they formed and having their scores negated by other players using bonus tiles 16. Such constant interaction not only provides an entertaining game to the end, it provides a constant change of lead due to the different scores achieved by longer words, bonus points, and the options of bonus tiles 16.

Figure 3:
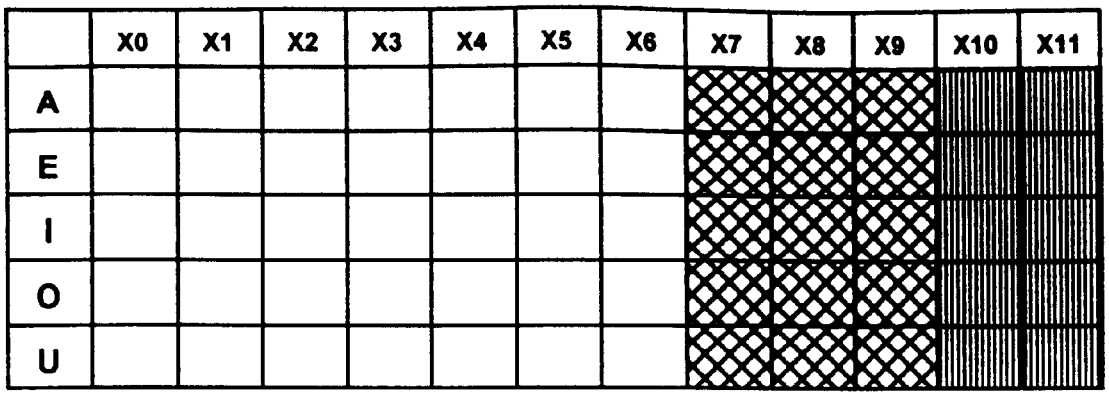
FIG. 3 depicts a top view of a five master letter (all English language vowels), twelve multiplier column, English language and alphabet version of the game board.

In another embodiment, FIG. 3, the game board 14 features seven horizontal rows 46 of boxes 48 drawn upon the game board 14. Each such horizontal row 46 contains thirteen of the horizontal boxes 48 dimensioned to accommodate the outside dimensions of the letter tiles 12 when laid thereon. The first box 48 in each row 46 being that of a letter of the alphabet of the language in which the game is being played, in this case a English language and alphabet vowel, in the conventional order starting from the top of the game board 14. The letter contained in the first such box of the row is considered the master letter 50 of that horizontal row 46. As depicted in the English version, there would be six master letters 50 in the English alphabet vowels. Since other versions of the game can also be produced in any number of languages and such is anticipated, the order of and number and characters of the master letters 50 could vary by language. However, in all cases the premise would be the same in that the alphabet of that language would be represented in order as master letters 50 of the horizontal rows 46.

In this embodiment of the game board 14, there exist thirteen vertical columns 52 also formed by the lines of the horizontal boxes 48. A first column being that of the aforementioned master letters 50 and twelve additional vertical columns 52 situated to the right of the master letters 50 thereby determining the number of horizontal boxes 48 to be used for play immediately adjacent to each master letter 50. The playing spaces, determined by the number of horizontal boxes 48, determines where letter tiles 12 may be laid during play. Each master letter 50 would therefor have twelve horizontal boxes 48 to the right of that master letter 50 in which letter tiles 12 may be played.

Each of the vertical columns 52 are labeled at the top of the respective vertical column 52 with a number starting from the left and increasing toward the right from zero through eleven. This numerical label thereby identifies and determines a multiplier 46 for points achieved on a word spelled by a player laying letter tiles 12 to the right of one of the master letters 50, depending upon which column the last letter tile 12 of the word formed, occupies. This multiplier 46 is used during play to multiply the score of the word formed by a player, by the factor of the multiplier 46.

Also included in this embodiment of the game board 14 are a plurality of colorized columns to award additional bonuses to players achieving word endings in these colorized columns. The columns designated with the multiplier of seven, eight, or nine are colorized in a first color 54, in the current mode orange, to indicate that bonus points are awarded for a word long enough to end in this column of the first color 54. The multiplier columns designated by the multiplier 46 labeled ten and eleven are also colorized with a second color 56 different from the first color 54 and the board color 58. This second color 56 signifies that the player formed a word long enough to end in the columns designated with the second color 56, and the player is awarded a bonus points and a bonus tile 16 for accomplishing the task. In the current best mode, the first color 54 is orange and the second color 56 would be maroon with the board color 58 being gray or neutral. Of course, the colors used could differ so long as they are different from each other to easily identify the bonus zone signified by the first color 54 and the second color 56.

This five master letter 50 game board 14 version is otherwise played in the same fashion as the twenty-six master letter 26 game board 14 version.

Figure 4:
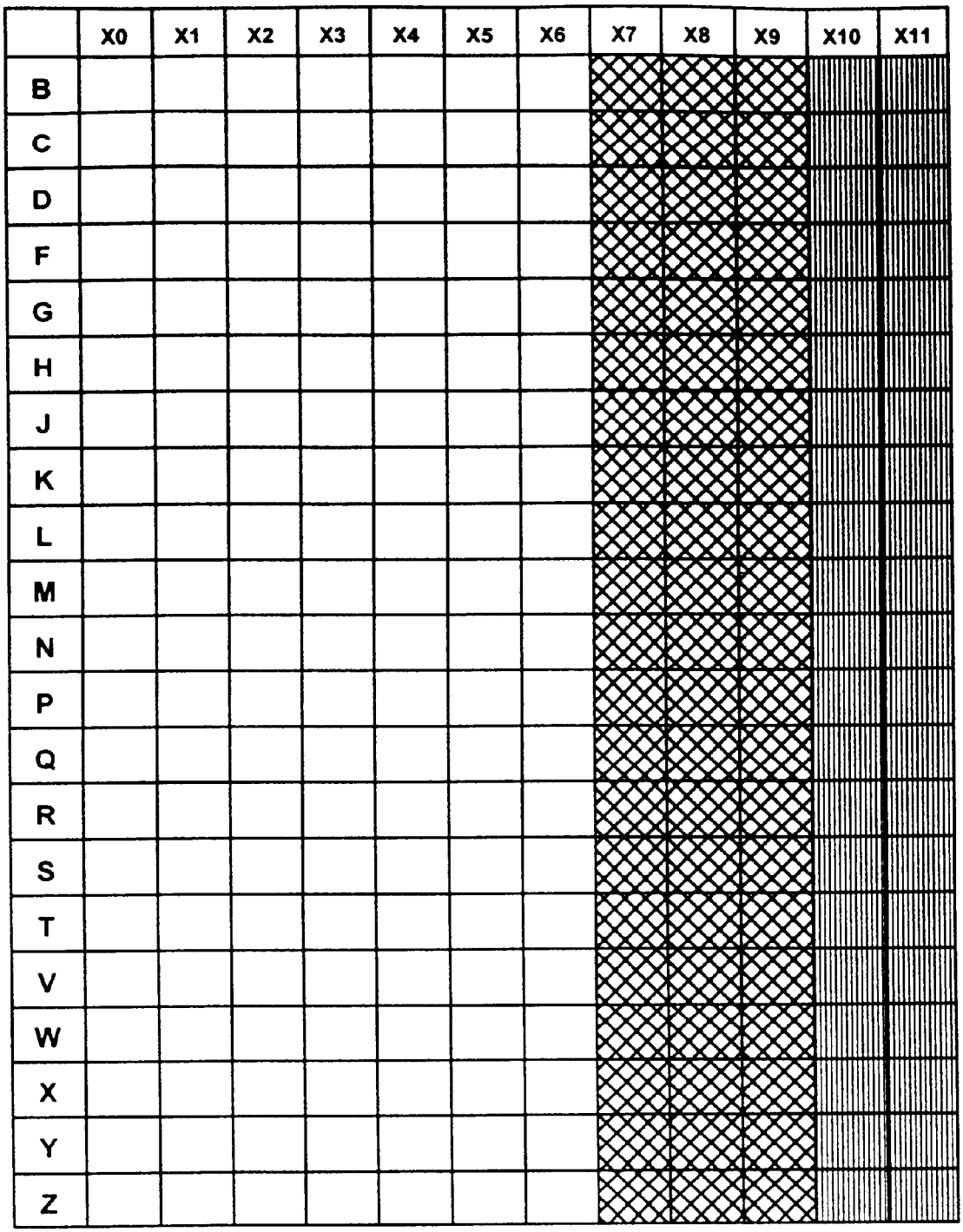
FIG. 4 depicts a top view of a twenty-one master letter (all English language consonants), twelve multiplier column, English language and alphabet version of the game board.

In another embodiment, FIG. 4, the game board 14 features twenty-two horizontal rows 60 of boxes 62 drawn upon the game board 14. Each such horizontal row 60 contains thirteen of the horizontal boxes 62 dimensioned to accommodate the outside dimensions of the letter tiles 12 when laid thereon. The first box 62 in each row 60 being that of a letter of the alphabet of the language in which the game is being played, in this case a English language and alphabet consonant, in the conventional order starting from the top of the game board 14. The letter contained in the first such box of the row is considered the master letter 64 of that horizontal row 60. As depicted in the English version, there would be twenty-one master letters 64 in the English alphabet vowels. Since other versions of the game can also be produced in any number of languages and such is anticipated, the order of and number and characters of the master letters 64 could vary by language. However, in all cases the premise would be the same in that the alphabet of that language would be represented in order as master letters 64 of the horizontal rows 60.

In this embodiment of the game board 14, there exist thirteen vertical columns 66 also formed by the lines of the horizontal boxes 62. A first column being that of the aforementioned master letters 64 and twelve additional vertical columns 66 situated to the right of the master letters 64 thereby determining the number of horizontal boxes 62 to be used for play immediately adjacent to each master letter 64. The playing spaces, determined by the number of horizontal boxes 62, determines where letter tiles 12 may be laid during play. Each master letter 64 would therefor have twelve horizontal boxes 62 to the right of that master letter 64 in which letter tiles 12 may be played.

Each of the vertical columns 66 are labeled at the top of the respective vertical column 66 with a number starting from the left and increasing toward the right from zero through eleven. This numerical label thereby identifies and determines a multiplier 60 for points achieved on a word spelled by a player laying letter tiles 12 to the right of one of the master letters 64, depending upon which column the last letter tile 12 of the word formed, occupies. This multiplier 60 is used during play to multiply the score of the word formed by a player, by the factor of the multiplier 60.

Also included on the game board 14 are a plurality of colorized columns to award additional bonuses to players achieving word endings in these colorized columns. The columns designated with the multiplier of seven, eight, or nine are colorized in a first color 68, in the current mode orange, to indicate that bonus points are awarded for a word long enough to end in this column of the first color 68. The multiplier columns designated by the multiplier 60 labeled ten and eleven are also colorized with a second color 70 different from the first color 68 and the board color 58. This second color 70 signifies that the player formed a word long enough to end in the columns designated with the second color 70, and the player is awarded a bonus points and a bonus tile 16 for accomplishing the task. In the current best mode, the first color 68 is orange and the second color 70 would be maroon with the board color 58 being gray or neutral. Of course, the colors used could differ so long as they are different from each other to easily identify the bonus zone signified by the first color 68 and the second color 70.

This twenty-one master letter 64 game board 14 version is otherwise played in the same fashion as the twenty-six master letter 26 game board 14 version.

Figure 5:
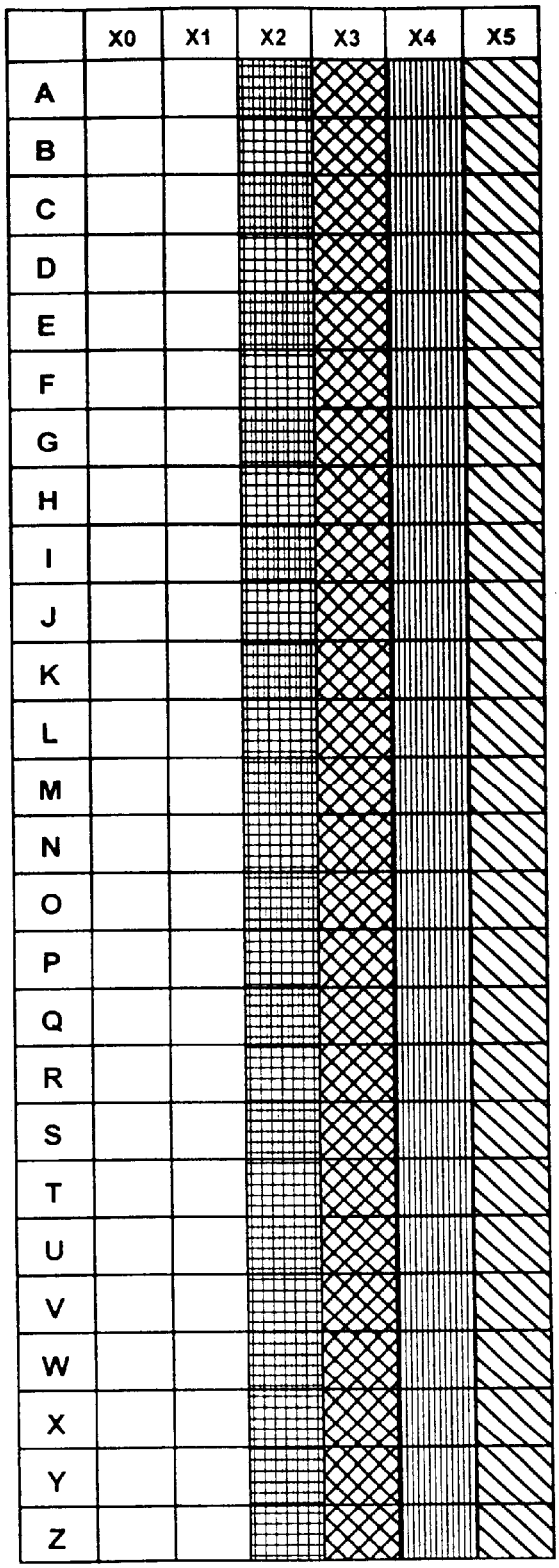
FIG. 5 depicts a top view of a twenty-six master letter, six multiplier column English language and alphabet version of the game board.

In another embodiment, FIG. 5, the game board 14 features twenty-seven horizontal rows 72 of boxes 74 drawn upon the game board 14. Each such horizontal row 72 contains seven of the horizontal boxes 74 dimensioned to accommodate the outside dimensions of the letter tiles 12 when laid thereon. The first box 74 in each row 72 being that of a letter of the alphabet of the language in which the game is being played, in this case a English language and alphabet, in the conventional order starting from the top of the game board 14. The letter contained in the first such box of the row is considered the master letter 76 of that horizontal row 72. As depicted in the English version, there would be twenty-six master letters 76 in the English alphabet. Since other versions of the game can also be produced in any number of languages and such is anticipated, the order of and number and characters of the master letters 76 could vary by language. However, in all cases the premise would be the same in that the alphabet of that language would be represented in order as master letters 76 of the horizontal rows 72.

In this embodiment of the game board 14, there exist seven vertical columns 78 also formed by the lines of the horizontal boxes 74. A first column being that of the aforementioned master letters 76 and six additional vertical columns 78 situated to the right of the master letters 76 thereby determining the number of horizontal boxes 74 to be used for play immediately adjacent to each master letter 76. The playing spaces, determined by the number of horizontal boxes 74, determines where letter tiles 12 may be laid during play. Each master letter 76 would therefor have six horizontal boxes 74 to the right of that master letter 76 in which letter tiles 12 may be played.

Each of the vertical columns 78 are labeled at the top of the respective vertical column 78 with a number starting from the left and increasing toward the right from zero through five. This numerical label thereby identifies and determines a multiplier 72 for points achieved on a word spelled by a player laying letter tiles 12 to the right of one of the master letters 76, depending upon which column the last letter tile 12 of the word formed, occupies. This multiplier 72 is used during play to multiply the score of the word formed by a player, by the factor of the multiplier 72.

Also included on the game board 14 are a plurality of colorized columns to award additional bonuses to players achieving word endings in these colorized columns. The column designated with the multiplier of two is colorized in a first color 80, in the current mode yellow, to indicate that bonus points are awarded for a word long enough to end in this column of the first color 80. The multiplier columns designated by the multiplier 72 labeled three is also colorized with a second color 82, in the current mode orange, different from the first color 80, and the board color 88, to indicate that bonus points are awarded for a word long enough to end in this column of the second color 82. The multiplier columns designated by the multiplier 72 labeled four is also colorized with a third color 84, in the current mode orange, different from the first color 80, the second color 82, and the board color 88, to indicate that bonus points are awarded for a word long enough to end in this column of the third color 84. The multiplier columns designated by the multiplier 72 labeled five is also colorized with a fourth color 86, in the current mode green, different from the first color 80, the second color 82, the third color 84, and the board color 88, to indicate that bonus points and a bonus tile 16 are awarded for a word long enough to end in this column of the fourth color 84. In the current best mode, the first color 80 is yellow, the second color 82 is orange, the third color 84 is maroon, and the fourth color 86 is green with the board color 88 being gray or neutral. Of course, the colors used could differ so long as they are different from the board color 88 and each other to easily identify the bonus zone signified by the first color 80, the second color 82, the third color 84, and the fourth color 86.

This twenty-one master letter 76, six multiplier 72 game board 14 version is otherwise played in the same fashion as the twenty-six master letter 26 game board 14 version.

Figure 6:
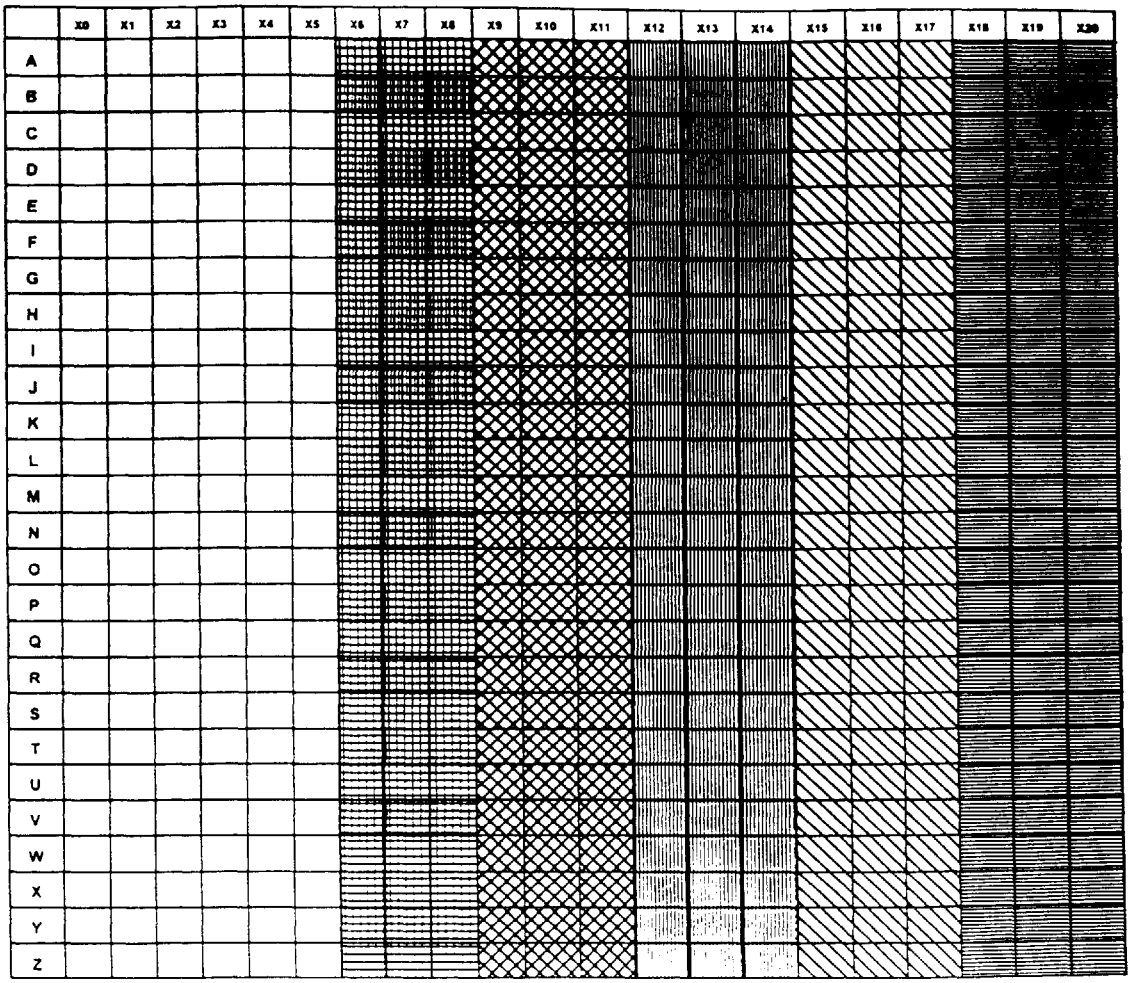
FIG. 6 depicts a top view of a twenty-six master letter, twenty-one multiplier column, English language and alphabet version of the game board.

In another embodiment, FIG. 6, the game board 14 features twenty-seven horizontal rows 90 of boxes 92 drawn upon the game board 14. Each such horizontal row 90 contains twenty-two of the horizontal boxes 92 dimensioned to accommodate the outside dimensions of the letter tiles 12 when laid thereon. The first box 94 in each row 90 being that of a letter of the alphabet of the language in which the game is being played, in this case a English language and alphabet, in the conventional order starting from the top of the game board 14. The letter contained in the first such box of the row is considered the master letter 94 of that horizontal row 90. As depicted in the English version, there would be twenty-six master letters 94 in the English alphabet. Since other versions of the game can also be produced in any number of languages and such is anticipated, the order of and number and characters of the master letters 94 could vary by language. However, in all cases the premise would be the same in that the alphabet of that language would be represented in order as master letters 94 of the horizontal rows 90.

In this embodiment of the game board 14, there exist twenty-two vertical columns 96 also formed by the lines of the horizontal boxes. A first column being that of the aforementioned master letters 94 and twenty-one additional vertical columns 96 situated to the right of the master letters 94 thereby determining the number of horizontal boxes 92 to be used for play immediately adjacent to each master letter 94. The playing spaces, determined by the number of horizontal boxes 92, determines where letter tiles 12 may be laid during play. Each master letter 94 would therefor have twenty-two horizontal boxes 92 to the right of that master letter 94 in which letter tiles 12 may be played.

Each of the vertical columns 96 are labeled at the top of the respective vertical column 96 with a number starting from the left and increasing toward the right from zero through twenty-one. This numerical label thereby identifies and determines a multiplier 90 for points achieved on a word spelled by a player laying letter tiles 12 to the right of one of the master letters 94, depending upon which column the last letter tile 12 of the word formed, occupies. This multiplier 90 is used during play to multiply the score of the word formed by a player, by the factor of the multiplier 90.

Also included on the game board 14 are a plurality of colorized columns to award additional bonuses to players achieving word endings in these colorized columns. The columns designated with the multipliers of six, seven and eight are colorized in a first color 98, in the current mode yellow, to indicate that bonus points are awarded for a word long enough to end in this column of the first color 98. The multiplier columns designated by the multipliers 90 labeled nine, ten and eleven are also colorized with a second color 100, in the current mode orange, different from the first color 98, and the board color 108, to indicate that bonus points are awarded for a word long enough to end in this column of the second color 108. The multiplier columns designated by the multipliers 90 labeled twelve, thirteen and fourteen are also colorized with a third color 102, in the current mode maroon, different from the first color 98, the second color 100, and the board color 108, to indicate that bonus points are awarded for a word long enough to end in this column of the third color 102. The multiplier columns designated by the multipliers 90 labeled fifteen, sixteen and seventeen are also colorized with a fourth color 104, in the current mode green, different from the first color 98, the second color 100, the third color 102, and the board color 108, to indicate that bonus points awarded for a word long enough to end in this column of the fourth color 84. The multiplier columns designated by the multipliers 90 labeled eighteen, nineteen and twenty are also colorized with a fifth color 106, in the current mode blue, different from the first color 98, the second color 100, the third color 102, the fourth color 104, and the board color 108, to indicate that bonus points awarded for a word long enough to end in this column of the fifth color 106. A bonus tile 16 is awarded for a word long enough to end in a column 90 determined before the start of game play.

In the current best mode, the first color 98 is yellow, the second color 100 is orange, the third color 102 is maroon, the fourth color 104 is green, and the fifth color 106 is blue, with the board color 108 being gray or neutral. Of course, the colors used could differ so long as they are different from the board color 108 and each other to easily identify the bonus zone signified by the first color 98, the second color 100, the third color 102, the fourth color 104, and the fifth color 106.

This twenty-one master letter 94, twenty multiplier 90 game board 14 version is otherwise played in the same fashion as the twenty-six master letter 26 game board 14 version.

Figure 7:
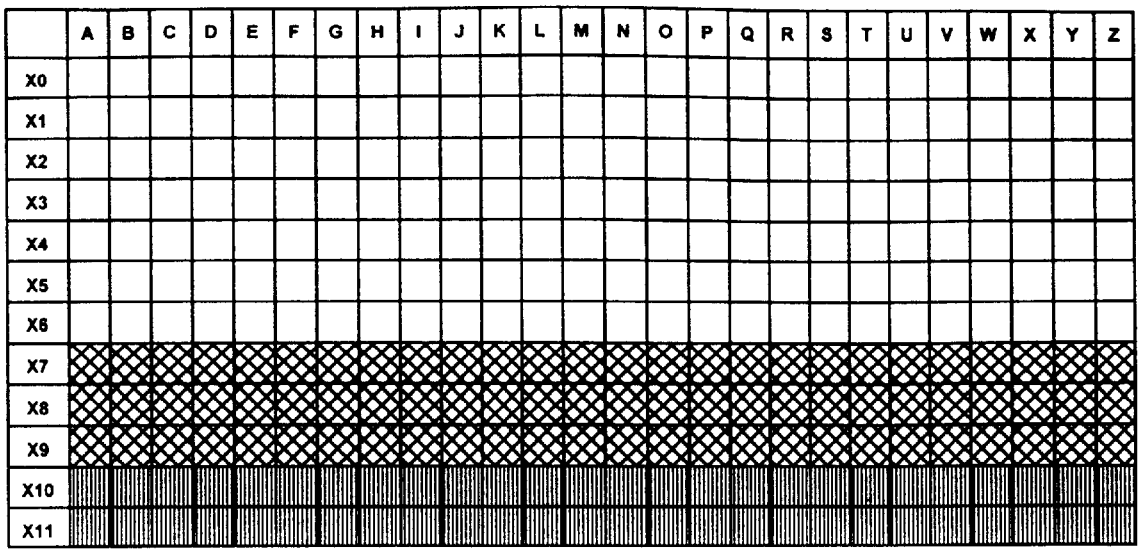
FIG. 7 depicts a top view of a reverse version of the game board depicted in FIG. 1.

In another embodiment, FIG. 7, the game board 14 is a reverse version of the game board 14 depicted in FIG. 2.

This twenty-one master letter 110, twelve vertical box 112 game board 14 version is played in the same fashion as the twenty-six master letter 26 game board 14 version depicted in FIG. 2.

It should be understood that while the current best embodiment of the device herein disclosed uses the Roman alphabet, the device may be produced in different languages using different indicia as the master letters 26. Also, the current best mode depicts certain placement of letters and actions based on columns and rows which could easily be reversed in position to yield the same result. Further, the disclosed game lends itself to reproduction electronically of the game board 14 on video screens and computers and using electronic scorecards to track player scores under the same rules as the disclosed embodiment. Such electronic use and reproduction are anticipated as is playing of the game on television game shows for prizes.

Still further, while all of the fundamental characteristics and features of the Board Word Game apparatus and method have been herein disclosed in the current best mode, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A Method of playing a game, on a game board, said game board divided into a plurality of horizontal rows, each of said horizontal rows segmented into a plurality of rectangles by a plurality of vertical columns intersecting said rows, each of the horizontal rows bearing a letter of an alphabet in a first column, each of the vertical columns labeled with one or a combination of a multiplier and a colorized zone, further comprising the steps of:

(a) distributing to players of said game, a defined number of letters having a letter value, from a defined collection of alphabet letters;

(b) each of said players, in order, positioning a chosen number of said letter tiles on said rectangles adjacent to said letter of an alphabet in the first column, on said game board, said letters so positioned to form one of a complete word, or, a longer word, said longer word formed by adding additional letters to said squares to form an additional end segment to a prior played complete word;

(c) calculating a point score for one of said complete word or said longer word in steps comprising:

(i) said point score for said complete word calculated by adding said letter values to a word sum with said first letter in the first column having a higher value than said letters placed adjacent thereto, multiplying said word sum by said multiplier intersecting said rectangle occupied by the last letter of said complete word and adding any bonus designated by said last letter of said complete word ending in a colorized zone;

(ii) said point score for said longer word calculated by adding the letter values of said longer word, each of said letter values of said longer word equaling a longer word sum, multiplying said longer word sum by said multiplier intersecting said rectangle occupied by the last letter of said longer word and adding to said longer word point score any bonus points awarded for ending said longer word in a colorized zone; and (iii) awarding bonus tiles for words or longer words formed by a player which terminate in a colorized zone, said bonus tiles playable by a player possessing them at any time during their turn, either as any letter of said collection of alphabet letters, or, to negate the score achieved by an opponent player during said opponents previous turn; and (d) repeating steps b and c until all the letters and bonus tiles have been played, or until no player is able to play any letters or bonus tiles.

2. The method of playing a game according to claim 1 further comprising the step of each of said players choosing replacement letter tiles from said collection of alphabet letters after each turn, thereby replenishing said defined number of letters held by said player.

3. The method of playing a game according to claim 1 wherein each of said horizontal rows bears a vowel and said number of horizontal rows is determined by the number of vowels in said letters of an alphabet.

4. The method of playing a game according to claim 1 wherein each of said horizontal rows bears a consonant and said number of horizontal rows is determined by the number of consonants in said letters of an alphabet.

5. The method of playing a game according to claim 1 wherein said plurality of columns is eleven.

6. The method of playing a game according to claim 1 wherein said plurality of columns is five.

7. The method of playing a game according to claim 1 wherein said plurality of columns is twenty.

8. The method of playing a game according to claim 1 further comprising each of said players tracking their individual score on score sheets.

9. The method of playing a game according to claim 1 wherein the game board is electronically reproduced and said game is played electronically on a computer.

10. The method of playing a game according to claim 1 wherein said game is played on television by contestants for prizes.

* * * * *